US005876502A

United States Patent [19]

Sugimura et al.

[11] Patent Number: 5,876,502

[45] Date of Patent: Mar. 2, 1999

[54] GLUE GUN TYPE GLUING APPARATUS

[75] Inventors: Hirofumi Sugimura; Yoshimitsu Ishibashi, both of Hiroshima-ken; Katsuhiko Koike; Hideaki Miyaoka, both of Tokyo, all of Japan

[73] Assignee: Nireco Corporation, Tokyo, Japan

[21] Appl. No.: 927,217

[22] Filed: Sep. 10, 1997

[30] Foreign Application Priority Data

Nov. 26, 1996 [JP] Japan ..... 8-314602

[51] Int. Cl.[6] ..... B05C 11/00

[52] U.S. Cl. ..... 118/712; 118/315; 118/324; 118/668; 118/669; 118/673; 118/675; 118/676; 118/679; 156/227; 156/356; 156/357; 156/578; 493/128; 493/131; 493/150; 493/151; 493/264

[58] Field of Search ..... 118/315, 324, 118/663, 668, 669, 670, 673, 674, 675, 676, 679, 681, 686, 698, 712, 713; 156/227, 356, 357, 578; 493/128, 131, 121, 130, 134, 150, 151, 264

[56] References Cited

U.S. PATENT DOCUMENTS

| | | | |
|---|---|---|---|
| 3,110,232 | 11/1963 | Frei | 118/679 |
| 3,340,847 | 9/1967 | Miller et al. | 118/668 |
| 3,541,930 | 11/1970 | Goodrich | 493/130 |
| 3,890,926 | 6/1975 | Teed | 118/669 |
| 4,013,037 | 3/1977 | Warning Sr. et al. | 118/324 |
| 4,328,061 | 5/1982 | Off et al. | 156/578 |
| 4,380,967 | 4/1983 | Matt | 118/669 |
| 4,389,969 | 6/1983 | Johnson | 118/669 |
| 4,389,971 | 6/1983 | Schmidt | 118/669 |
| 4,491,490 | 1/1985 | Ehret et al. | 118/669 |
| 4,704,603 | 11/1987 | Edwards et al. | 493/128 |
| 4,836,440 | 6/1989 | French | 493/128 |
| 5,024,709 | 6/1991 | Faulkner III et al. | 493/128 |
| 5,061,519 | 10/1991 | Long | 118/669 |
| 5,098,734 | 3/1992 | O'Dea et al. | 118/712 |
| 5,242,499 | 9/1993 | Bergman | 118/669 |
| 5,252,353 | 10/1993 | DiGiulio et al. | 118/669 |
| 5,334,249 | 8/1994 | Osbon | 118/679 |
| 5,375,722 | 12/1994 | Leary et al. | 493/128 |

FOREIGN PATENT DOCUMENTS

| | | | |
|---|---|---|---|
| 771570 | 11/1967 | Canada | 118/712 |
| 4220048 | 12/1993 | Germany | 118/663 |
| 4-260466 | 9/1962 | Japan | 118/712 |
| 58-77654 | 5/1983 | Japan | 118/712 |
| 6-226886 | 8/1994 | Japan | 493/264 |
| 6-226887 | 8/1994 | Japan | 493/264 |
| 7-333156 | 12/1995 | Japan . | |

*Primary Examiner*—Peter Chin
*Assistant Examiner*—Michael P. Colaianni
*Attorney, Agent, or Firm*—Fish & Richardson P.C.

[57] ABSTRACT

A glue gun type gluing apparatus has glue guns 8*a* and 8*b* for applying glue to a gluing area in a joint flap 2 of a corrugated board sheet 1 for manufacturing a box, which runs on a box manufacturing line, a sheet end detection sensor 3 for detecting the front and rear ends of the corrugated board sheet 1, an encoder 7 for measuring the travel distance of the corrugated board sheet 1, and a control unit 9 for controlling the operation of the glue guns 8*a* and 8*b*. The control unit 9 learns and stores the position of gluing area on the basis of the information from the sheet end detection sensor 3 and the encoder 7 while the corrugated board sheet 1 is run at a low speed, and restricts the acquisition of detection signals by the sensor 3 during the time from the passing of the end point of the joint flap 2 to the arrival of the start point of the next joint flap 2.

4 Claims, 5 Drawing Sheets

GLUE GUN TYPE GLUING APPARATUS

FIELD OF THE INVENTION AND RELATED ART STATEMENT

The present invention relates to a glue gun type gluing apparatus which is installed on a corrugated fiberboard box manufacturing machine to supply glue to a joint flap at the corrugated board (cardboard) sheet width end, which is necessary for box manufacturing.

A corrugated board box manufacturing machine for manufacturing corrugated board boxes is configured as shown in the general configuration view of FIG. 3. Usually, a corrugated board sheet 1 stacked in a board supply section 51 is sent out one after another, first printed at a printing section 52, and then sent to a slotter creaser section 53, where creases 61 indicated by broken lines in FIG. 4 are put on the corrugated board sheet 1 at a creasing section 54 in the slotter creaser section 53. Then, slots 62 and unwanted portions 64 of a joint flap 2, which are indicated by hatching in FIG. 4, are cut with a slotter shaft 55 and removed in the slotter creaser section 53. Next, the corrugated board sheet 1 is folded in a folding section 56, and discharged by being stacked to a pile of a predetermined number of sheets in a counter stacker section 57. The corrugated board sheet 1 is conveyed by many conveying rollers 59 and a belt conveyor 60.

At the inlet portion of the folding section 56 is provided a gluing apparatus 58. Before the folding process in the folding section 56 just after the cutting operation of unwanted portions 64 of the joint flap 2 with the slotter shaft 55, glue is applied to the joint flap 2 by using this gluing apparatus 58.

Thus, to manufacture corrugated board boxes, gluing of required portion is needed. Therefore, a gluing apparatus 58 has conventionally been installed on a corrugated board box manufacturing machine. One of such gluing apparatuses 58 is a glue gun type gluing apparatus.

FIGS. 5 and 6 illustrate a conventional glue gun type gluing apparatus installed on a corrugated board box manufacturing machine as described above. FIG. 5 is a general configuration view of the apparatus, and FIG. 6 is a schematic plan view for illustrating the operation thereof.

As shown in FIG. 5, the conventional glue gun type gluing apparatus has a sheet end detection sensor 3, an encoder 7, a set of glue gun 23, an electrical control panel 24, and a glue line detecting scanner 25.

Among these elements, the sheet end detection sensor 3 is disposed corresponding to the central portion of the width of the corrugated board sheet 1 on the travel line (the line indicated by dashed arrows in FIG. 5). The encoder 7 is connected to a pulley 6 driven by pulley 4 via a timing belt 5, the pulley 4 being fixed to the shaft end of a feed roll portion etc. outside the view showing the transfer of the corrugated board sheet 1, and the glue gun incorporates a solenoid valve. The electrical control panel 24 is used to set the value of glue injection timing from the glue gun 23 on the basis of the detection signal from the sheet end detection sensor 3 and the encoder 7. The glue line detecting scanner 25 is used to check the state of glue lines N applied to the joint flap 2 of the corrugated board sheet 1. The check result of this scanner 25 is also sent to the electrical control panel 24.

In order to supply glue 13 to the glue gun 23, a glue reservoir 26, a glue pipe 16, and a glue pump 27 are provided as a glue supply section, so that the glue 13 put in the glue reservoir 26 is fed to the glue gun 23 via the glue pipe 16 by being driven by the glue pump 27.

Further, to control the injection pressure of glue from the glue gun 23, an air control panel 28 for controlling the injection pressure of glue from the glue gun 23 and air pipes 29 for supplying a predetermined compressed air from the air control panel 28 to the glue gun 23 are provided.

A glue applying head 30 is mounted at the tip end of the glue gun 23. Several types of glue applying heads 30 having one to six nozzles corresponding to the required number of glue lines are prepared. Among these glue applying heads 30, a set of glue applying head 30 having nozzles corresponding to the required number of glue lines is selected and mounted.

By such a configuration, before manufacturing a box, the operator first measures the dimensions regarding the gluing part of the corrugated board sheet 1 which is passed through the box manufacturing machine. Specifically, as shown in FIG. 6, dimension A from the front end of the corrugated board sheet 1 to the rear end of the gluing position and dimension B from the front end of the corrugated board sheet 1 to the front end of the gluing position are measured. The operator inputs and sets specified values determined by giving consideration of the relative position between the sheet end detection sensor 3 and the glue gun 23 to these measured values to the electrical control panel 24. The reason why measurement is thus made regarding the gluing part of the corrugated board sheet 1 and the values are input and set to the electrical control panel 24 is because the corrugated board sheet 1 has a variety of shapes and setting is needed according to various kinds of the corrugated board sheet 1.

After the setting is made, when the corrugated board sheet 1 is fed in the direction indicated by an arrow in FIG. 6, the front end of the corrugated board sheet 1 is detected by the sheet end detection sensor 3. The glue gun 23 is supplied with compressed air having a predetermined pressure set at the air control panel 28 and glue 13 sucked from the glue reservoir 26 by the glue pump 27, and the solenoid valve of the glue gun 23 is activated at a predetermined timing calculated by the detection signal from the sheet end detection sensor 3, the number of pulses obtained by the encoder 7, and the values set to the electrical control panel 24.

Thereupon, as shown in FIG. 6, glue is applied to section C (=A−B) only from when distance B is passed from the sheet end (front end) to when distance A is passed at the joint flap 2 of the corrugated board sheet 1, so that glue lines N are formed in this section C. The glue line detecting scanner 25, which is fixed to a position close to the glue lines N above the upper surface of the joint flap 2, detects the state in which the glue line N is not continuous (i.e., discontinuous glue line) or other troubles, and carries out control for stopping the supply of the corrugated board 1 by electrical control when detecting any trouble.

However, the conventional glue gun type gluing apparatus as described above has various problems described below in terms of the configuration and function thereof.

In the above-described glue gun type gluing apparatus explained as the prior art, the sheet end detection sensor 3 is disposed at a position deviating from the passage of the joint flap 2 of the corrugated board sheet 1, so that it detects only the tip end of the fed corrugated board sheet 1. Therefore, when the length of the glue line N is set corresponding to the position and length of the joint flap 2, it is necessary to measure the sheet regarding the glue injection start and end positions for each production lot and then to input the measured values manually to the electrical control panel. Accordingly, the measurement and setting operations are required for each order change (lot change), and much time is taken to change the setting, so that the rate of operation of the box manufacturing machine is reduced, and in turn, the productivity is decreased significantly.

Needless to say, if the sheet end detection sensor 3 is disposed at a position above the travel line of the joint flap 2 of the corrugated board sheet 1, the measurement and setting operations for each order change (lot change) can be omitted partially, so that the increase in productivity can be expected by the shortened time for changing the setting. However, if the sensor is located at the position above the travel line of the joint flap 2, there arise problems described below. This is a reason why the sensor is positioned away from the travel line of the joint flap 2.

The corrugated board box manufacturing machine cuts a rectangular sheet as shown in FIG. 4. In the vicinity of a gluing part 63, the unwanted portion (scrap portion) 64 as indicated by hatching in FIG. 4 is cut just before the gluing part 63. By this cutting operation, a board scrap is produced and flies off to the gluing part 63 and its vicinity especially in high-speed operation. In particular, if such a board scrap is present between the gluing parts 63 of two corrugated board sheets running at an appropriate distance, mistaken detection is done, and further malfunction is caused. Specifically, despite of the fact that a board scrap merely passes through the sheet end detection sensor 3, the sheet end detection sensor 3 reacts and carries out mistaken detection such as to take the passing of a board scrap for the passing of the end of corrugated board sheet. As a result, by the control based on this mistaken detection, malfunction such that the glue gun is operated mistakenly is caused.

Since the scraps of the scrap portions 64 drop by gravity, measures for directing the scraps downward or sideward by providing a high-speed air nozzle can be taken. Even if such measures are taken, however, when the running speed of the corrugated board 1 is high, the movement of scraps cannot be controlled, and large amounts of scraps fly off to the vicinity of the gluing part. Therefore, the scraps flying off to the gluing part cause the malfunction of the sheet end detection sensor 3.

Also, in the conventional glue gun type gluing apparatus, only one set of glue gun is provided, and the number of glue lines N is changed by replacing the glue gun tip (glue applying head) having a different number of nozzles. Therefore, only one kind of glue line length can be set, so that at the joint flap having a notch groove, for example, glue cannot be applied over the total width including the groove.

OBJECT AND SUMMARY OF THE INVENTION

The present invention was made to solve the above problems, and accordingly an object thereof is to provide a glue gun type gluing apparatus which can directly detect a sheet end without causing a malfunction of detecting device relating the sheet end so that the change of setting relating to gluing can be made easily and properly in a short period of time, by which the productivity of box manufacture can be improved.

Another object of the present invention is to provide a glue gun type gluing apparatus in which the control of glue gun is easy, and a plurality of glue lines can be applied (set) automatically and exactly in the joint flap area of a corrugated board sheet.

Still another object of the present invention is to provide a glue gun type gluing apparatus in which plural kinds of glue lines with different lengths can be applied in the joint flap area of a corrugated board sheet.

To achieve the above objects, the glue gun type gluing apparatus of the present invention defined in claim 1 comprises: a glue gun for applying glue to a gluing area in a joint flap at the side end of a corrugated board sheet for manufacturing a box, which runs on a box manufacturing line; a sheet end detection sensor for detecting that the front and rear ends of the joint flap of a corrugated board sheet running on the box manufacturing line have arrived at a predetermined position; an encoder for measuring the travel distance of a corrugated board running on the box manufacturing line; and a control unit for controlling the operation of the glue gun. The control unit executes a learning mode in which the distance between the start and end points of the joint flap of a corrugated board sheet running on the box manufacturing line is grasped on the basis of the detection information from the sheet end detection sensor and the measurement information from the encoder while a corrugated board sheet is run at a low speed below a predetermined speed on the box manufacturing line, and the positions of start and end points of the gluing area with respect to the passing of start point of the joint flap are learned and stored, and an ordinary mode in which the operation of the glue gun is controlled at the injection start and end timing based on the positions of start and end points of the gluing area with respect to the passing of start point of the joint flap stored by the learning mode and the information from the sheet end detection sensor and the encoder, and the acquisition of detection signals by the sheet end detection sensor is restricted during the time from the passing of the end point of the joint flap of a corrugated board sheet to the arrival of the start point of the joint flap of the next corrugated board sheet on the basis of the detection information from the sheet end detection sensor.

By this configuration, the learning mode is first executed through the control unit. Specifically, while the corrugated board sheet is run at a low speed below a predetermined speed on the box manufacturing line, the start point detection signal and end point detection signal of the joint flap of corrugated board sheet are received from the sheet end detection sensor, the travel distance of the corrugated board sheet measured by the encoder during the time from the receipt of the start point detection signal to the receipt of the end point detection signal is input, and based on this, the positions of start and end points of the gluing area with respect to the passing of start point of the joint flap are learned and stored.

In this learning mode, since learning is effected while the corrugated board sheet is run at a low speed below the predetermined speed, board scraps etc. produced by the cutting of the corrugated board sheet 1 easily drop from the box manufacturing line, so that the scraps etc. do not remain in the vicinity of the joint flap. Therefore, mistaken detection due to board scraps etc. is avoided when the start and end points of the joint flap is detected by the sheet end detection sensor.

Next, the ordinary mode is executed through the control unit. Specifically, after the passing of start point of the joint flap is detected by the sheet end detection sensor, the operation of glue gun is controlled at the injection start and end timing based on the positions of start and end points of the gluing area with respect to the passing of start point of the joint flap, stored by the learning mode, and the travel distance of corrugated board sheet measured by the encoder.

In this ordinary mode, after the passing of the end point of the joint flap of corrugated board sheet is detected on the basis of the detection information from the sheet end detection sensor, the acquisition of detection signals by the sheet end detection sensor is restricted until the arrival of the start point of the joint flap of the next corrugated board sheet. Therefore, even if the board scrap etc. produced by the cutting of the corrugated board sheet passes through the detection area of the sheet end detection sensor during the time until the arrival of the start point of the joint flap of the next corrugated board sheet, mistaken detection such that the sheet end detection sensor takes the scrap etc. for the start point of the joint flap is avoided.

The glue gun type gluing apparatus of the present invention defined in claim 2 is such that in the apparatus according to claim 1, the glue gun consists of at least two sets of glue guns having one to several nozzles, with the injection start and end timing of one glue gun among these plural glue guns being taken as the reference timing, the control unit stores, in advance, the correction value regarding the injection start and end timing of other glue guns, and the plural glue guns are operated on the basis of the reference timing and the correction value by the control unit.

By this configuration, one glue gun among the plural glue guns is operated at the reference timing, and other guns are operated on the basis of the reference timing and the correction value, by which glue is applied to the joint flap so that the kind and length of glue line is different for each glue gun.

DETAILED DESCRIPTION OF PREFERRED EMBODIMENTS

Figure 1:
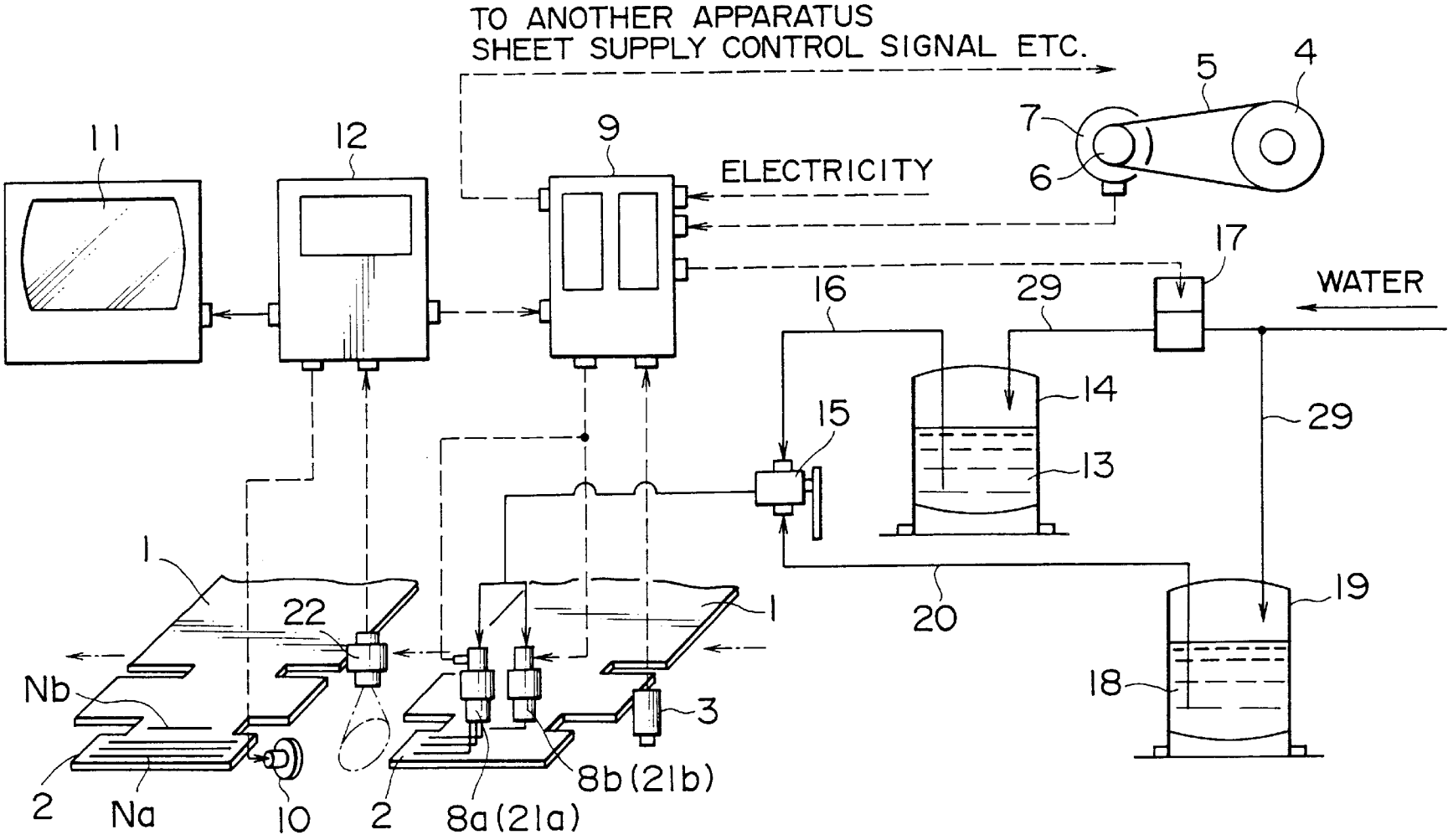
FIG. 1 is a general configuration view of a glue gun type gluing apparatus in accordance with one embodiment of the present invention.
Figure 2:
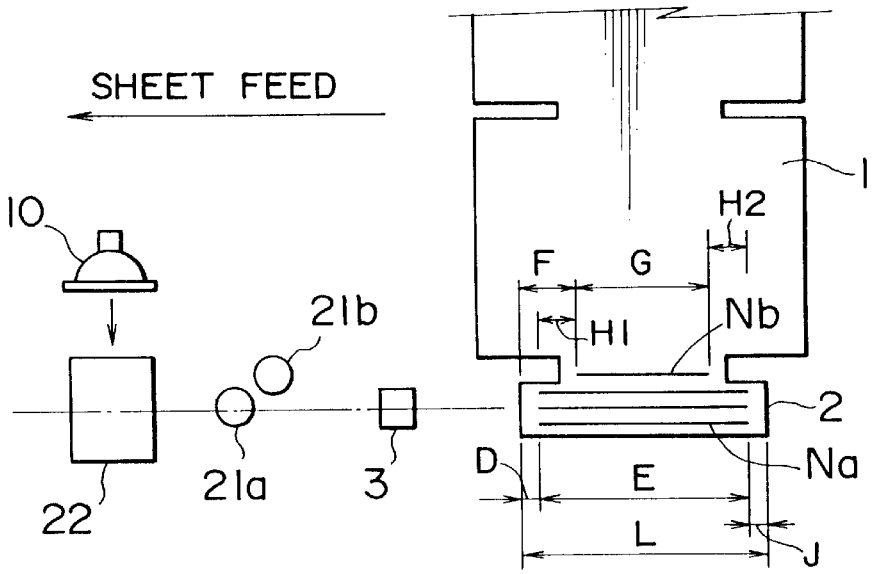
FIG. 2 is a schematic plan view for illustrating the operation of a glue gun type gluing apparatus in accordance with one embodiment of the present invention.

One embodiment of the present invention will be described below with reference to the accompanying drawings. FIGS. 1 and 2 show a glue gun type gluing apparatus in accordance with one embodiment of the present invention.

First, a corrugated board box manufacturing machine provided with the glue gun type gluing apparatus will be explained. Since the corrugated board box manufacturing machine is the same as that of prior art explained with reference to FIG. 3, it will be explained with reference to FIG. 3.

Figure 3:
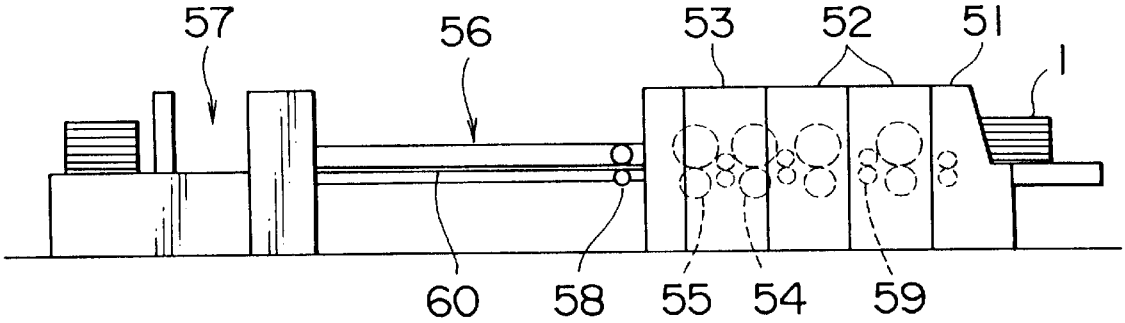
FIG. 3 RELATED ART
FIG. 3 is a general configuration view of a conventional corrugated board box manufacturing machine.

As shown in FIG. 3, the corrugated board box manufacturing machine provided with the glue gun type gluing apparatus has a board supply section 51, slotter creaser section 53, creasing section 54, slotter shaft 55, folding section 56, and counter stacker section 57 from the upstream part of the box manufacturing line. The gluing apparatus is provided at the inlet portion of the folding section 56.

Figure 4:
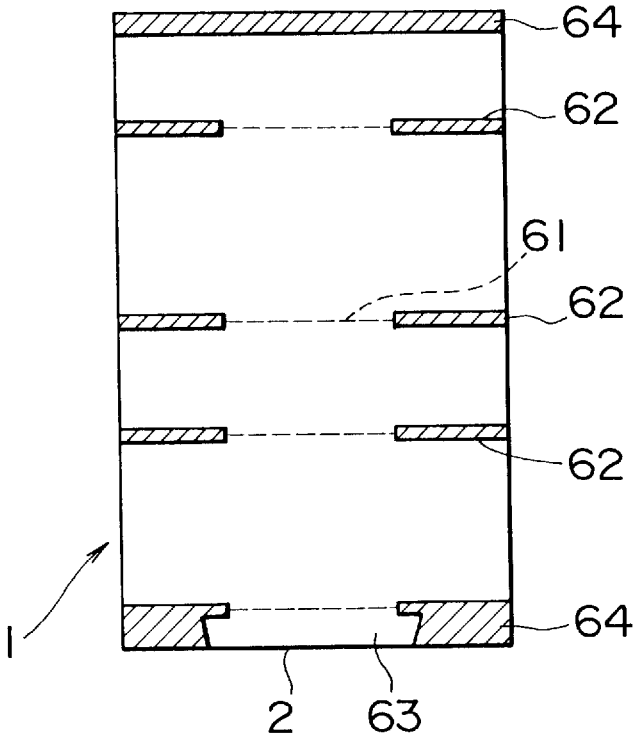
FIG. 4 RELATED ART
FIG. 4 is a schematic plan view for illustrating the working of a corrugated board sheet.
Figure 5:
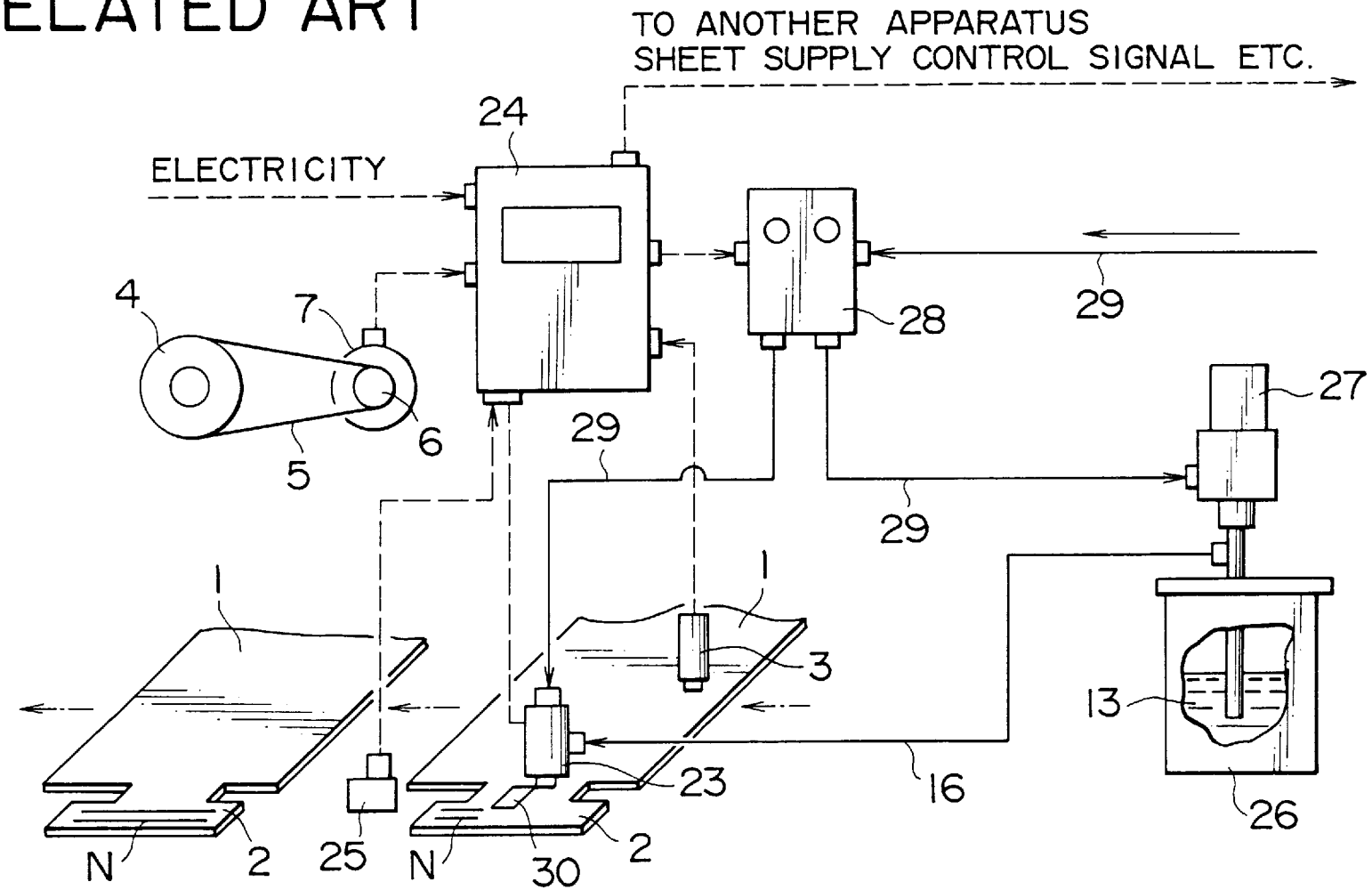
FIG. 5 RELATED ART
FIG. 5 is a general configuration view of a conventional glue gun type gluing apparatus.
Figure 6:
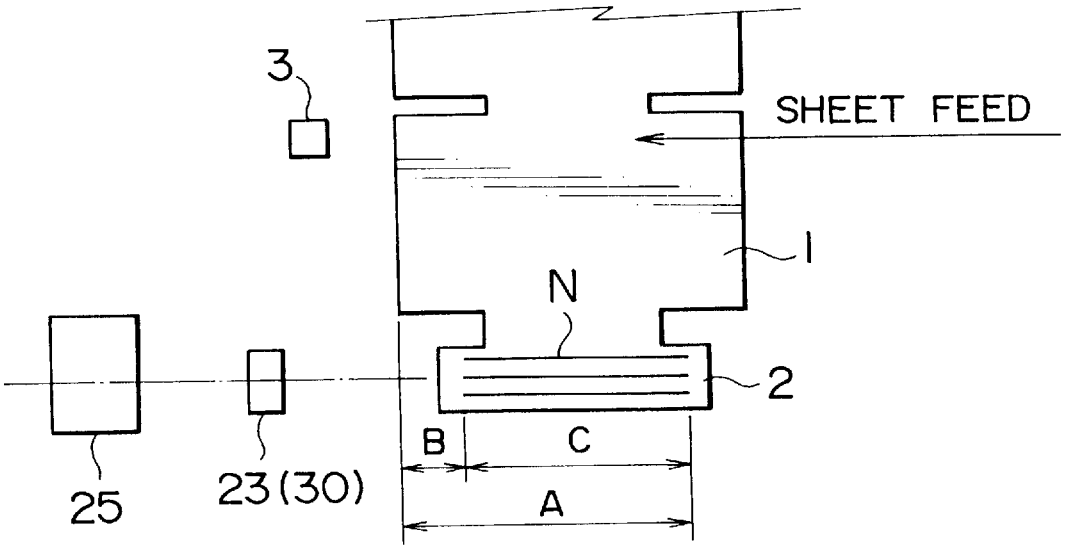
FIG. 6 RELATED ART
FIG. 6 is a schematic plan view for illustrating the operation of a conventional glue gun type gluing apparatus.

On this corrugated board box manufacturing machine, usually, a corrugated board sheet 1 stacked in a board supply section 51 is sent out one after another, first printed at a printing section 52, and then sent to a slotter creaser section 53, where creases 61 indicated by broken lines in FIG. 4 are put on the corrugated board sheet 1 at a creasing section 54 in the slotter creaser section 53. Then, slots 62 and unwanted portions 64 of a joint flap 2, which are indicated by hatching in FIG. 4, are cut with a slotter shaft 55 and removed in the slotter creaser section 53. Next, the corrugated board sheet 1 is folded in a folding section 56, and discharged by being stacked to a pile of a predetermined number of sheets in a counter stacker section 57. The corrugated board sheet 1 is conveyed by many conveying rollers 59 and a belt conveyor 60.

Before the folding process in the folding section 56 just after the cutting operation of unwanted portions 64 of the joint flap 2 with the slotter shaft 55, glue is applied to the joint flap 2 by using the gluing apparatus 58.

The glue gun type gluing apparatus of this embodiment has a sheet end detection sensor 3, an encoder 7, two sets of glue guns 8*a* and 8*b*, and a gluing electrical control panel 9 and a glue line inspection electrical control panel 12, which are control units.

Among these elements, the sheet end detection sensor 3 is disposed above the travel line (the line indicated by dashed arrows in FIG. 1) of the joint flap 2 of the corrugated board sheet 1, and the encoder 7 is connected to a pulley 6 driven by pulley 4 via a timing belt 5, the pulley 4 being fixed to the shaft end of a feed roll portion etc. outside the view showing the transfer of the corrugated board sheet 1. The encoder 7 measures the travel distance of the corrugated board sheet 1 running on the travel line from the rotational speed of the feed roll portion etc. The glue guns 8*a* and 8*b* each incorporate a solenoid valve. By, for example, energizing this solenoid valve, glue is discharged from the glue guns 8*a* and 8*b*. The glue guns 8*a* and 8*b* are controlled individually.

The gluing electrical control panel 9 controls the solenoid valves of the glue guns 8*a* and 8*b* independently at a predetermined timing by receiving a detection signal from the sheet end detection sensor 3 and a detection signal from the encoder 7. The glue line inspection electrical control panel 12 photographs glue lines N applied to the joint flap 2 of the corrugated board sheet 1 with a halogen lamp 10 and a camera 22, and feeds the video signal obtained by the photographing to a glue line inspection screen 11 of a monitor TV set.

The camera 22, which is disposed above the passage line (above the travel line) of the joint flap 2 of the corrugated board sheet 1, catches the glue lines N as shadow by the projection of light from the halogen lamp 10, and the photographed image is output onto the glue line inspection screen 11 of the monitor TV set. The glue line inspection screen 11 of the monitor TV set enables visual monitoring, and if a trouble such as a discontinuous glue line occurs, the supply of the corrugated board sheet 1 is stopped automatically, or the position of defective sheet from the final position is displayed so as to select (remove) it easily in the subsequent process, by the electrical control through the glue line inspection electrical control panel 12. Although not shown, in addition to the above-mentioned control, other control can be carried out, for example, so as to inform the operator of the defective state using alarm means such as a revolving light or a buzzer if a trouble occurs.

In order to supply glue 13 to the glue guns 8*a* and 8*b*, a glue tank 14 filled with the glue 13, a manually operable three-way switching valve 15, and glue pipes 16 are provided. To supply cleaning water 18 to the glue guns 8*a* and 8*b*, a water pressure-feeding tank 19 filled with water 18, and a water supply pipe 20 are provided. Also, an electro-pneumatic converter 17 is provided to convert an electrical signal, which is set at the gluing electrical control panel 9 from various conditions such as the running speed of the corrugated board sheet 1 and the state of glue 13, into a pneumatic pressure.

The pneumatic pressure converted from an electrical signal by the electro-pneumatic converter 17 is supplied to the glue tank 14 through an air pipe 29, and the primary pressure of the electro-pneumatic converter 17 is supplied into the water pressure-feeding tank 19 through an air pipe 29. The glue 13 and the water 18 contained in the tanks 14 and 19, respectively, are pressurized by the supplied compressed air and fed to the three-way switching valve 15. By the path switching of this three-way switching valve, the glue 13 or the water 18 is selectively supplied to the glue guns 8*a* and 8*b*.

If the three-way switching valve 15 is operated, for example, manually, the water 18 in the water pressure-feeding tank 19 is supplied to the glue guns 8*a* and 8*b* to automatically clean the interior of glue gun and a tip end glue applying head (nozzle) portion, so that clogging caused by the solidification of glue etc. can be eliminated easily and reliably.

At the gluing electrical control panel (control unit) 9, either of learning mode and ordinary mode (production mode) can be selected.

If the learning mode is set, the gluing electrical control panel 9 sends a sheet supply control signal to another apparatus, not shown, and receives the detection signal of start point of the joint flap 2 of the corrugated board sheet 1 and the detection signal of end point thereof from the sheet end detection sensor 3 while the corrugated board sheet 1 is run at a low speed below a predetermined speed. Also, the travel distance of the corrugated board sheet 1 measured by the encoder 7 during the time from the receipt of the start point detection signal to the receipt of the end point detection signal is input to the gluing electrical control panel 9. Based on this, the gluing electrical control panel 9 learns and stores the positions of start and end points of the gluing area with respect to the passing of start point of the joint flap 2.

That is to say, the gluing area on the joint flap 2 can be set automatically through the gluing electrical control panel 9 so that a position at a predetermined distance from the front end of the joint flap 2, which is set in advance, is taken as the start point, and a position at a predetermined distance from the rear end of the joint flap 2, which is set in advance, is taken as the end point.

In this learning mode, learning is effected while the corrugated board sheet 1 is run at a low speed below a predetermined speed, and gluing is not done. When the corrugated board sheet 1 is run at a low speed, board scraps etc. produced by the cutting of the corrugated board sheet 1 easily drop from the box manufacturing line by gravity. Therefore, the scraps etc. do not remain in the vicinity of the joint flap 2. Also, the predetermined speed, which is the upper limit of speed of the corrugated board sheet 1 in the learning mode, is set as a speed such that the board scraps easily drop from the box manufacturing line by gravity.

In the ordinary mode (production mode), after the sheet end detection sensor 3 detects the passing of start point of the joint flap 2, the operation of the glue gun is automatically controlled through the gluing electrical control panel 9 at the injection start and end timing based on the positions of start and end points of the gluing area with respect to the passing of start point of the joint flap 2, stored by the learning mode, and the travel distance of corrugated board sheet measured by the encoder.

In the ordinary mode, after the gluing electrical control panel (control unit) 9 detects the rear end of the corrugated board sheet 1 (that is, the rear end of the joint flap 2) passing through the detection point of the sheet end detection sensor 3 by using the sheet end detection sensor 3, electrical masking is done until the front end of the next corrugated board sheet 1 (that is, the front end of the joint flap 2) arrives at the detection point of the sheet end detection sensor 3, so that mistaken detection caused by a board scrap flying to a position between the corrugated board sheet 1 fed sequentially and the next corrugated board sheet 1, that is, the malfunction of the sensor 3 caused by the board scrap momentarily blocking the sensor 3 is prevented, by which the control is carried out so that the machine is not stopped by the occurrence of a trouble such as a discontinuous glue line.

The electrical masking, which must be such that although the detection signal of the passing of the front end of the corrugated board sheet 1 (joint flap 2) is taken in effectively, the passing of the board scrap is not taken in as an effective detection signal, can be done by the signal processing based on the difference in detection characteristics between the passing of the front end of the corrugated board sheet 1 (joint flap 2) and the passing of the board scrap.

For the sheet end detection sensor 3, for example, a reflection type photoelectric tube, a transmission type photoelectric tube, etc. can be used. Assuming that, for example, the sensor turns on when a board is present at the detection point and off when it is absent, this sensor 3 turns on momentarily for a very short period of time when a board scrap passes through the detection point of the sensor 3, and it turns on continuously for a long period of time when the joint flap 2 of the sheet passes through the detection point of the sensor 3. Therefore, the signal of the sheet end detection sensor 3 is processed by, for example, a low-pass filter or an integration circuit, by which electrical masking is done during the time from the passing of the rear end of the joint flap 2 of a corrugated board sheet 1 to the arrival of the front end of the joint flap 2 of the next corrugated board sheet 1 at the detection point of the sheet end detection sensor 3, while the passing of the front end of the joint flap 2 is surely detected. Thereby, the control can be carried out so that mistaken detection caused by a board scrap flying to a position between the corrugated board sheet 1 and the next corrugated board sheet 1 is prevented.

A glue applying head 21 at the tip end of the respective glue guns 8*a* and 8*b* can be changed. A plurality of glue applying heads 21 for a different number of glue lines are prepared for each of glue guns 8*a* and 8*b*. By attaching a head having the number of nozzles corresponding to the intended number of glue lines to each glue gun 8*a*, 8*b*, glue of corresponding glue lines can be applied.

For example, as shown in FIG. 2, one glue gun 8*a* is equipped with a three-line glue applying head 21*a* and the other glue gun 8*b* is equipped with a one-line glue applying head 21*b*, and the injection timing of the head 21*b* is shifted in front and rear with respect to the head 21*a*, which is the reference, by the input of a correction value, which enables two kinds of glue application with different glue line lengths.

Regarding one glue gun 8*a*, when the gluing area is set automatically through the gluing electrical control panel 9 by the aforesaid learning mode, for example, as shown in FIG. 2, so that a position at a predetermined distance D from the front end of the joint flap 2 is taken as a start point and a position at a predetermined distance J from the rear end of the joint flap 2 is taken as an end point, the glue gun 8*a* starts the injection of glue at the time point when the joint flap 2 advances the predetermined distance D from the detection of the front end of the joint flap 2, and subsequently continues the injection of glue until advancing a distance E (=L−D−J) calculated in advance from the total length of the joint flap 2 and the predetermined distances D and J by the learning mode, then stopping the injection of glue when advancing the distance E.

Regarding the other glue gun 8*b*, when, with the case of the glue gun 8*a* being the basic timing, the injection of glue is started at a distance H1 rearward from the case of the glue gun 8*a*, and ended at a distance H2 frontward from the case of the glue gun 8*a*, the values H1 and H2 or the numerical values corresponding to these are input to the gluing electrical control panel 9 as the correction values for injection timing. Thereby, for the glue gun 8*b*, the injection of glue is controlled at an injection timing such that a position at a distance F (=D+H1), which is obtained by the correction of the predetermined distance D, from the front end of the joint flap 2 is taken as a start point, and a position at a distance G (=E−H1−H2), which is obtained by the correction of the distance E, from the start point is taken as an end point.

Accordingly, by the automatic setting through the gluing electrical control panel 9, as shown in FIG. 2, the glue gun 8*a* applies the glue 13 continuously in section E with a space of D provided from the front end of the joint flap 2 as shown in FIG. 2 by using the glue applying head 21*a*, and on the other hand, the glue gun 8*b* applies the glue 13 continuously in section G with a space of F provided as shown in FIG. 2 by using the glue applying head 21*b*. These glue guns 8*a* and 8*b* can draw three glue lines Na and one glue line Nb, respectively.

The gluing apparatus is so designed that depending on the shape of the joint flap 2, only one set of glue applying head 21*a* can be set to be operative and the head 21*b* inoperative.

Since the glue gun type gluing apparatus of this embodiment is configured as described above, the learning mode is first set. At the operation start of a box manufacturing machine, usually, one to several corrugated board sheet 1 are passed on trial at a low speed to check the quality of printing etc. The learning mode is set when this trial passing is done. In other words, the learning mode can be set without adding a new process.

In the learning mode, while the corrugated board sheet 1 is run at a low speed below a predetermined speed on the box manufacturing line through the gluing electrical control panel 9, the detection signal of start point of the joint flap 2 of the corrugated board sheet 1 and the detection signal of end point thereof are sent from the sheet end detection sensor 3 to the gluing electrical control panel 9, and the travel distance of the corrugated board sheet 1 measured by the encoder 7 during the time between the receipt of the start point detection signal to the receipt of the end point detection signal is input to the gluing electrical control panel 9. Based on these pieces of information, the gluing electrical control panel 9 learns and stores the positions of start and end points of the gluing area with respect to the passing of start point of the joint flap 2. Also, the correction values H1 and H2 of injection timing of the glue gun 8*b* with respect to the gluing area are input to the gluing electrical control panel 9.

The learning mode by direct detection of the joint flap 2 provides an advantage that the measurement and setting operations, which have conventionally been required for each order change (lot change), can be made unnecessary or simplified, the time taken for setting change can be shortened significantly, and the rate of operation of the box manufacturing machine can be increased, so that the productivity can be enhanced greatly.

In this learning mode, since learning is effected while the corrugated board sheet 1 is run at a low speed below the predetermined speed, board scraps etc. produced by the cutting of the corrugated board sheet 1 easily drop by gravity from the box manufacturing line, so that the scraps etc. do not remain in the vicinity of the joint flap 2. Therefore, a board scrap etc. is not detected mistakenly as the end of the corrugated board sheet 1 by the sheet end detection sensor 3, and the end of the corrugated board sheet 1 is detected surely so that the learning can be effected accurately.

Next, the mode is switched to the ordinary mode (production mode). In this ordinary mode, after the sheet end detection sensor 3 detects the passing of start point of the joint flap 2, while the passing position of the joint flap 2 is recognized by the information from the encoder 7, the joint flap 2 reaches the start point of the gluing area at distance D from the start point of the joint flap 2, which has been stored by the learning mode, and then the injection of glue 13 by the glue gun 8*a* is started. Subsequently, the glue gun 8*a* continues the injection of glue 13. When the joint flap 2 advances distance E after the start of injection, the injection of glue 13 by the glue gun 13 is stopped. Meanwhile, when the joint flap 2 reaches the start point at distance F (=D+H1), which is obtained by correcting distance D, from the front end of the joint flap 2 while the passing position of the joint flap 2 is recognized, the injection of glue 13 by the glue gun 8*b* is started. Subsequently, the glue gun 8*b* continues the injection of glue 13. When the joint flap 2 advances distance G after the start of injection, the injection of glue 13 by the glue gun 8*b* is stopped.

As a result, as shown in FIG. 2, the glue gun 8*a* applies the glue 13 of three glue lines Na continuously in section E with a space of D provided from the front end of the joint flap 2 as shown in FIG. 2 by using the glue applying head 21*a*, and on the other hand, the glue gun 8*b* applies the glue 13 of one glue line Nb continuously in section G with a space of F provided as shown in FIG. 2 by using the glue applying head 21*b*.

In the ordinary mode, after the gluing electrical control panel (control unit) 9 detects the rear end of the corrugated board sheet 1 (that is, the rear end of the joint flap 2) passing through the detection point of the sheet end detection sensor 3 by using the sheet end detection sensor 3, electrical masking is done until the front end of the next corrugated board sheet 1 (that is, the front end of the joint flap 2) arrives at the detection point of the sheet end detection sensor 3, so that even if a board scrap flies to a position between the corrugated board sheet 1 fed sequentially and the next corrugated board sheet 1, mistaken detection such that the board scrap is taken for the corrugated board sheet 1 is prevented. Therefore, gluing can be done properly, and the occurrence of a trouble such as a discontinuous glue line can be prevented, so that the machine is prevented from being stopped by the occurrence of a trouble.

For this reason as well, the rate of operation of the box manufacturing machine can be increased, so that the productivity can be enhanced significantly.

Moreover, plural kinds of glue lines Na and Nb with a different number of lines and different applying positions can be applied easily by very simple setting.

Also, according to the gluing apparatus, when the three-way switching valve 15 is operated, for example, manually, the water 18 in the water pressure-feeding tank 19 is supplied to the glue guns 8*a* and 8*b*, and by this operation, the interior of glue gun and the tip end glue applying head (nozzle) portion is cleaned, so that clogging caused by the solidification of glue etc. can be eliminated.

Also, while monitoring the monitor TV glue inspection screen 11, if a trouble such as a discontinuous glue line occurs, the supply of the corrugated board sheet 1 is stopped automatically, or the defective sheet can be selected (removed) easily in the subsequent process by displaying the position of defective sheet from the final position. In addition to the above-mentioned control, other control can be carried out, for example, so as to inform the operator of the defective state using alarm means such as a revolving light or a buzzer if a trouble occurs.

The present invention is not limited to the above embodiment, and, for example, many glue guns may be provided. In this case as well, the operation timing of each glue gun can be set easily by the setting of the correction value with respect to the basic timing. In addition to this, various modifications may be made in the present invention without departing from the spirit and scope of the invention.

According to the glue gun type gluing apparatus of the present invention defined in claim 1, the following effects can be achieved.

Since the acquisition of detection signals by the sheet end detection sensor in the zone outside the area of joint flap is restricted, the malfunction of sheet end detection sensor caused when the corrugated board sheet is running, for example, mistaken detection of sensor caused by flying board scraps is prevented, so that machine shutdown caused by this mistaken detection can be prevented.

Since the glue gun can be operated by automatic control after the length and position of the joint flap, which is a joint portion of corrugated board sheet, are measured in the learning mode, the control of glue gun is made easy, and for example, a plural number of glue lines can be applied automatically and exactly in the area of joint flap.

According to the glue gun type gluing apparatus of the present invention defined in claim 2, since plural sets of glue guns are provided, and based on the operation timing of one glue gun, the operation timing of other glue guns are corrected and set, plural kinds of glue lines with different lengths can be applied in the area of joint flap.

We claim:

1. A glue gun apparatus for applying glue to a gluing area in a joint flap of a corrugated board sheet for manufacturing a box on a box manufacturing line comprising:

a conveyor for said corrugated board to be glued;

at least one glue gun at a predetermined position for applying glue to said corrugated board joint flap, with respect to said conveyor;

a sheet end detection sensor positioned to detect arrival of at least one end of said joint flap of said corrugated board sheet on said conveyor in proximity to said predetermined position;

a control unit for controlling the operation of said glue gun;

an encoder coupled to said conveyor and connected to said control unit for transmitting data to said control unit concerning the travel distance of said corrugated board running on said conveyor; and a set of instructions residing in a computer-readable form in said control unit for causing said control unit to:

(a) in a learning mode, determine the distance between a start and an end point of a joint flap of a corrugated board sample from the information provided by the signals from said sheet end detection sensor and said encoder, and store in said control unit the positions of a start and an end point of said gluing area with respect to the passing of start point of said joint flap of said corrugated board sample, and (b) in an operating mode, control operation of said glue gun to apply glue with the glue start and end timing based on the stored positions of said start and end points of said gluing area with respect to the passing of said start point of a joint flap of a second corrugated board sheet, and on the information from said sheet end detection sensor and said encoder, and restrict the acquisition of detection signals by said control unit from said sheet end detection sensor during the time from said end point of said joint flap of said second corrugated board sheet passing said sensor to the arrival at said sensor of said start point of said joint flap of a next corrugated board sheet on the basis of the detection information from said sheet end detection sensor.

2. A glue gun apparatus according to claim 1, wherein said glue gun consists of at least two sets of glue guns having one to several nozzles, with the glue applying start and end timing of one glue gun among these plural glue guns being taken as the reference timing, said control unit stores, in advance, a correction value regarding the glue applying start and end timing of other glue guns, and said plural glue guns are operated on the basis of said reference timing and said correction value by said control unit.

3. A glue gun apparatus for applying glue to a gluing area in a joint flap having start and end points of a corrugated board sheet for manufacturing a box comprising:

a glue gun positioned above conveyor means for moving a sample corrugated board sheet at a first speed on said box manufacturing line in a learning mode of operation, a controller for controlling the operation of said glue gun, means for producing a signal from a sheet end detection sensor indicating arrival of at least one end of the joint flap of said sample on said conveyor means in said learning mode of operation, encoder means coupled to said conveyor means for producing a signal indicative of the speed of said conveyor means in said learning mode of operation, means for determining the distance between the start and end points of said joint flap of said sample from the information provided by the signals from said sheet end detection sensor and said encoder means in said learning mode of operation, means for storing in said controller the positions of start and end points of said gluing area with respect to the passing of start point of said joint flap in said learning mode of operation; and means within said controller for causing said conveyor means to move a second corrugated board sheet to be glued in an operating mode of operation at a second speed which is higher than said first speed, said sheet having the same dimension in the direction of conveyor movement as said sample, means for producing a signal from said sheet end detection sensor indicating arrival of at least one end of the joint flap of said second sheet to be glued in said operating mode of operation, means for producing a signal from said encoder means in said operating mode of operation, means for operating said glue gun to apply glue under control of said controller in said operating mode of operation with the glue start and end timing based on the stored positions of start and end points of said gluing area with respect to the passing of start point of said joint flap and on the information from said sheet end detection sensor and said encoder means, and means for restricting the acquisition of detection signals by said controller from said sheet end detection sensor in said operating mode of operation during the time from the end point of said joint flap of said second corrugated board sheet passing said sensor to the arrival at said sensor of the start point of said joint flap of a third corrugated board sheet on the basis of the detection information from said sheet end detection sensor.

4. A glue gun apparatus according to claim 3 having multiple glue guns, each having at least one nozzle, comprising:

means for storing in said controller unit a correction value with respect to the start and end timing of a first glue gun, and in said operating mode, means in said controller for controlling the glue guns other than said first glue gun on the basis of said start and end timing of said first glue gun and said correction value.

* * * * *

UNITED STATES PATENT AND TRADEMARK OFFICE

CERTIFICATE OF CORRECTION

PATENT NO. : 5,876,502

DATED : March 2, 1999

INVENTOR(S) : Sugimura, et al.

It is certified that error appears in the above-identified patent and that said Letters Patent is hereby corrected as shown below:

Col. 14, Claim 4, line 4, after "controller" delete "unit".

Signed and Sealed this

Tenth Day of August, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,876,502

DATED : March 2, 1999

INVENTOR(S) : Sugimura et al.

It is certified that error appears in the above-identified patent and that said Letters Patent is hereby corrected as shown below:

On the title page, Item [73]:

"Nireco Corporation, Tokyo, Japan" should read --Mitsubishi Heavy Industries, Ltd., Tokyo, Japan, and Nireco Corporation, Tokyo, Japan--

Signed and Sealed this

Fifth Day of October, 1999

*Attest:*

*Attesting Officer*

Q. TODD DICKINSON

*Acting Commissioner of Patents and Trademarks*